US005251973A

United States Patent [19]

Hazan

[11] Patent Number: 5,251,973

[45] Date of Patent: Oct. 12, 1993

[54] LOCKER ORGANIZER OR THE LIKE

[75] Inventor: Syd Hazan, Richmond Hill, Canada

[73] Assignee: Hillmar Inc., Montreal, Canada

[21] Appl. No.: 848,339

[22] Filed: Mar. 9, 1992

[51] Int. Cl.[5] ..... A47B 45/00

[52] U.S. Cl. ..... 312/257.1; 312/265.1; 211/186

[58] Field of Search ..... 312/257.1, 265.1, 265.2, 312/265.6; 211/186, 187, 188, 181

[56] References Cited

U.S. PATENT DOCUMENTS

| | | | |
|---|---|---|---|
| 508,237 | 11/1893 | Pierce | 312/257.1 |
| 2,761,568 | 9/1956 | Temple | 211/186 |
| 3,341,270 | 9/1967 | Sohl | 312/257.1 |
| 3,435,958 | 4/1969 | Chesley | 211/186 |
| 4,288,130 | 9/1981 | Baldwin | 312/265.1 |
| 4,391,378 | 7/1983 | Secon | 211/187 |
| 4,500,146 | 2/1985 | Peterson | 312/257 |
| 4,616,756 | 10/1986 | Holtz | 211/181 |
| 4,732,284 | 3/1988 | Remmers | 211/188 |
| 4,754,885 | 7/1988 | Rich | 211/181 |
| 4,763,579 | 8/1988 | Cibulak | 108/48 |
| 4,778,066 | 10/1988 | Stjernberg | 211/186 |
| 4,793,664 | 12/1988 | Jackson | 312/306 |
| 4,805,785 | 2/1989 | Pfeifer et al. | 211/188 |
| 4,808,875 | 2/1989 | Edwards | 312/245 |
| 4,818,044 | 4/1989 | Dobry | 312/257 |
| 4,984,694 | 1/1991 | Magnusson | 211/186 |

FOREIGN PATENT DOCUMENTS

| | | | |
|---|---|---|---|
| 0084870 | 8/1983 | European Pat. Off. | 312/257.1 |
| 1182304 | 6/1959 | France | 312/257.1 |
| 2548529 | 1/1985 | France | 312/257.1 |

*Primary Examiner*—Victor N. Sakran
*Attorney, Agent, or Firm*—Krass & Young

[57] ABSTRACT

A shelving unit for placement at the bottom of a storage locker is formed of wire rods welded together. It includes a pair of planar side members adapted to be supported in abutment with the opposed side walls of the locker and a pair of shelf members with U-shaped hook members on opposed sides adapted to engage pairs of closely vertically spaced horizontal rods extending between forward and rear vertical legs of each side member. The U-shaped hooks formed on opposed shelf edges extend upwardly, normal to the shelf surfaces and then downwardly so that the open ends of the U's extend over a pair of horizontal rods. Because the shelves space the end sections by the width of the locker, they force the side members into abutment with the opposed side walls of the locker to provide stability to an otherwise unstable structure.

4 Claims, 2 Drawing Sheets

LOCKER ORGANIZER OR THE LIKE

FIELD OF THE INVENTION

This invention relates to a shelving unit adapted to be supported on the bottom of a storage locker with the opposed side walls o the unit abutting the sides of the locker, and more particularly to such a unit formed of planar sections of wire rods which may be easily assembled and disassembled.

BACKGROUND OF THE INVENTION

Storage lockers for retaining clothing and personal effects such as books and shoes are commonly used in schools, sports, clubs, industrial and commercial institutions. These lockers are largely standardized in size and typically have side walls approximately 12" apart and a depth of about 15". They usually have a top shelf permanently affixed to the side walls of the locker. Often it is desirable to add additional shelves extending between the side walls of the locker. U.S. Pat. No. 4,500,146 discloses such a removable shelf assembly employing four upright rails and telescoping shelves having hooks on their corners which engage the rails. This shelf may be assembled at the bottom of a storage locker so that the rails engage the opposed side walls of the locker and the shelves extend between the rails and provide additional storage and organizing space within the locker.

SUMMARY OF THE INVENTION

The present invention is directed toward a shelf assembly which may be easily erected within the bottom of a storage locker to provide additional shelving space, which is easy to erect, is low in cost, convenient in use, highly stable, and disassembles into substantially planar sections for convenient packaging.

A preferred embodiment of the invention, which will subsequently be disclosed in detail, is preferably formed of planar sections of wire rods with their intersections welded together. The preferred embodiment includes a par of planar side members adapted to be supported in abutment to the opposed side walls of the storage locker at the bottom. Each side member comprises a pair of vertical support rods joined together by horizontal rods which space the vertical rods by substantially the depth of a standard storage locker. The side members include one or more pairs of closely spaced horizontal rods having their ends secured to the opposed vertical rods, with each pair forming a shelf supporting structure. The shelf assembly further comprises one or more substantially planar, rectangular, shelf members having series of spaced U-shaped hooks formed along two opposed sides of the shelf with the two groups of hooks spaced by a distance substantially equal to the width of a standard storage locker.

The hooks on the sides of each shelf member are adapted to extend over and engage the horizontal shelf support structures formed on each pair of side members. The U-shaped hooks have a depth at least equal to the spacing between a pair of rods forming the shelf supporting structure.

Because the shelves support the side walls apart from one another by a distance equal to the width of the locker they force the side members into abutment with the side walls of the locker, lending stability to the structure.

The shelving assembly may be easily erected within a locker by placing the side members against the side walls of the locker, at the bottom, and engaging the hooked ends of the shelves over the horizontal shelf supporting structures on the side members. When disassembled, the side members and the shelves are substantially planar and easily stored and shipped in a relatively flat package.

The hook members formed on the opposed edges of each shelf are preferably formed by bends made at the ends of wire rod members forming part of the rectangular grid of rods which form each shelf. The hooks extend upwardly from what is the top surface of the shelf when assembled, so that the array of hooks and the shelf supporting structure on the side members which the hooks engage, form side walls for the shelves.

The resulting structure is highly effective as a storage system, low in cost, and easy to assembly, disassemble and package.

Other objectives, advantages and applications of the present invention will be made apparent by the following detailed description of a preferred embodiment of the invention. The description makes reference to the accompanying drawings in which.

DETAILED DESCRIPTION OF THE PREFERRED EMBODIMENT

Figure 1:
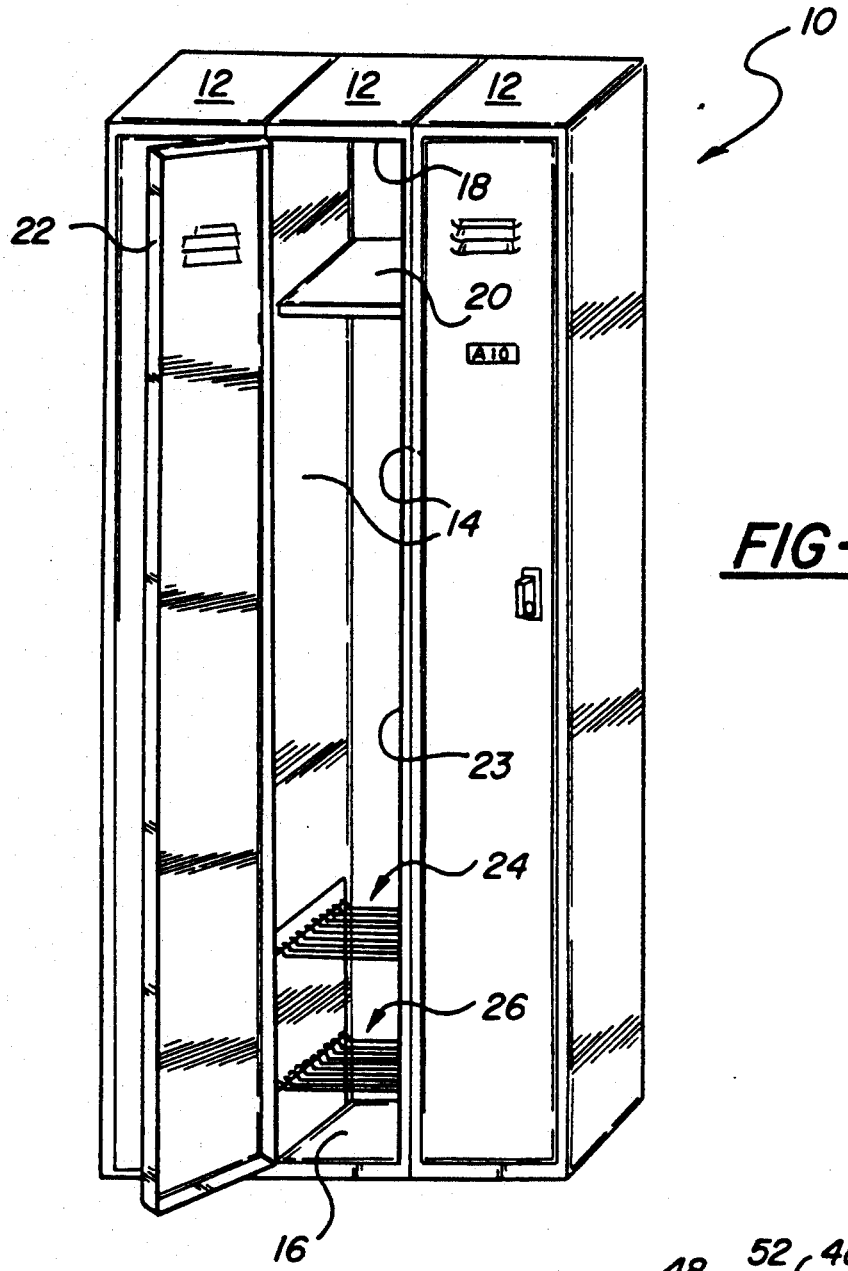
FIG. 1 is a perspective view illustrating a preferred embodiment of the shelf assembly of the present invention as a storage locker.

Referring to FIG. 1, a conventional storage locker of the type with which the shelf assembly of the present invention is intended for use is generally illustrated at 10. This is the type of locker which often line the hallways of schools and is employed in sports clubs, factories and the like to retain the clothing and personal effects of users. The lockers are typically arranged in banks of individual locker sections 12 and each locker section includes a vertically arrayed, rectangular storage space bounded by a pair of side walls 14, a bottom 16, and a top wall 18. Typically, a permanent, rectangular storage shelf 20 is located near the top of the locker space and extends horizontally between the opposed side walls 14. A door 22, supported in a frame 23, allows access to the locker.

The shelf assembly of the present invention is intended to be supported on the bottom 16 of the locker to provide a pair of shelves generally indicated at 24 and 26 extending horizontally, between the side walls of the locker at conveniently spaced intervals above the bottom 16 for the storage of shoes, books, work tools or the like. While the preferred embodiment of the present invention employs two shelves 24 and 26, in alternative embodiments a different number of shelves could be provided.

The shelf members 24 and 26 engage and cooperate with a pair of side members, generally indicated at 28 and 30. The shelf members 24 and 26 are identical and interchangeable with one another as are the side members 28 and 30.

Each side member 28 and 30 is formed of a rectangular frame of a continuous section of wire rod with its free ends welded together, to form a pair of vertical members 31 and 32, a bottom member 34 and a top member 36. This outer frame is preferably formed of wire approximately 3/16 of an inch in diameter. The wires of the side frame, like the other wire components of the shelf assembly, are preferably vinyl coated, allowing the use of low cost steel rod. Alternatively, the components could be formed of uncoated aluminum, plastic or other suitable materials.

The vertical members 31 and 3 of each side frame 28 and 30, are preferably spaced by a distance slightly less than the depth of a standard locker, typically 15 inches, so that the vertical members may be supported with one in engagement with the rear corner of the locker and the other in engagement with the forward corner of the locker, formed by the door frame 23.

Each side member includes two pairs of horizontally extending rods 38 having lengths equal to the distance between the vertical members 30 and 32, with the ends of the rods 38 welded to the respective vertical members 30 and 32. Each pair of rods acts as a shelf supporting structure. The rods are preferably spaced by ½ inch. The rods 38 may be thinner than the rods which form the outer frame of the side members and they are preferably about ⅛ inch in diameter.

Each shelf member 24 and 26 is formed by a rectangular grid of front-to-rear extending wire rods 40 and laterally extending wire rods 42 The preferred embodiment of the shelves 24 and 26 employs four of the front-to-rear extending rods 40, each spaced from one another by approximately three inches. The preferred embodiment employs twelve of the lateral members 42, spaced from one another by slightly in excess of 1¼ inches, so that the separation between the two end rods 42 is substantially 14¼ inches. The intersections of the rods 40 and 42 are welded together before the vinyl coating is applied.

Figure 4:
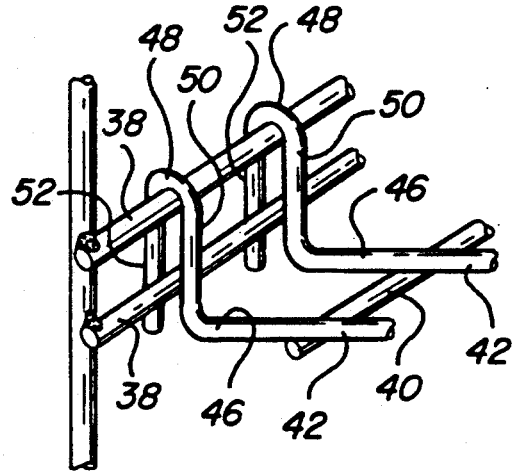
FIG. 4 is an exploded, perspective, detailed view of the area of engagement between the hooks on the end of the shelf and the horizontal support structure of a shelf side member.
Figure 2:
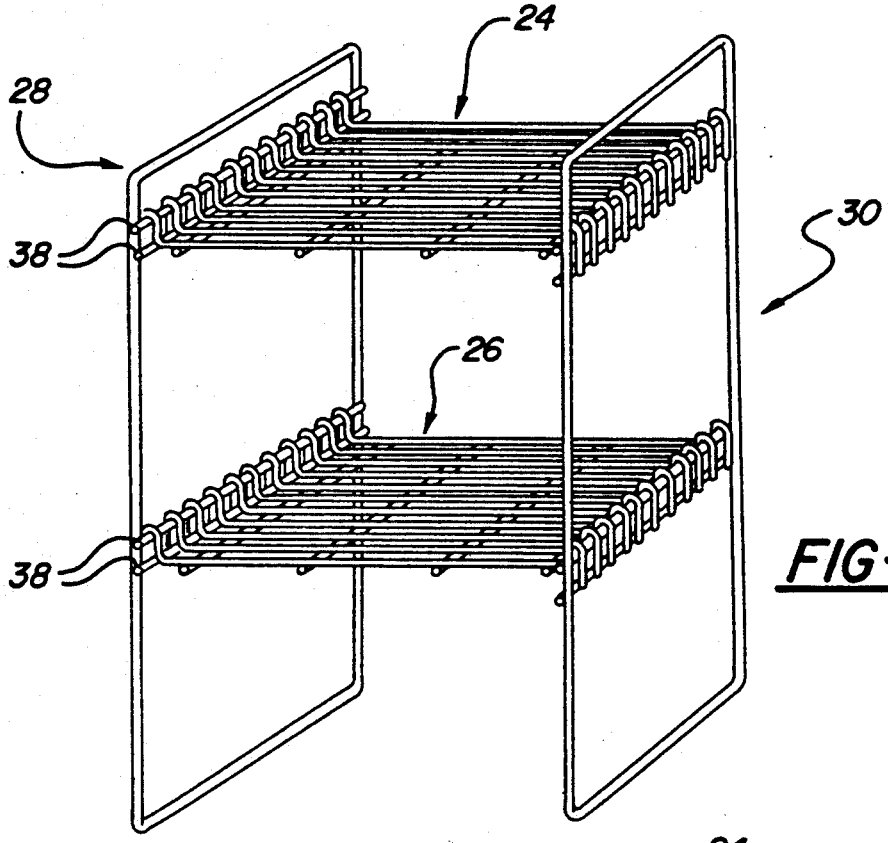
FIG. 2 is a perspective view of the shelving unit of FIG. 1 in assembled form, outside of a storage locker.
Figure 3:
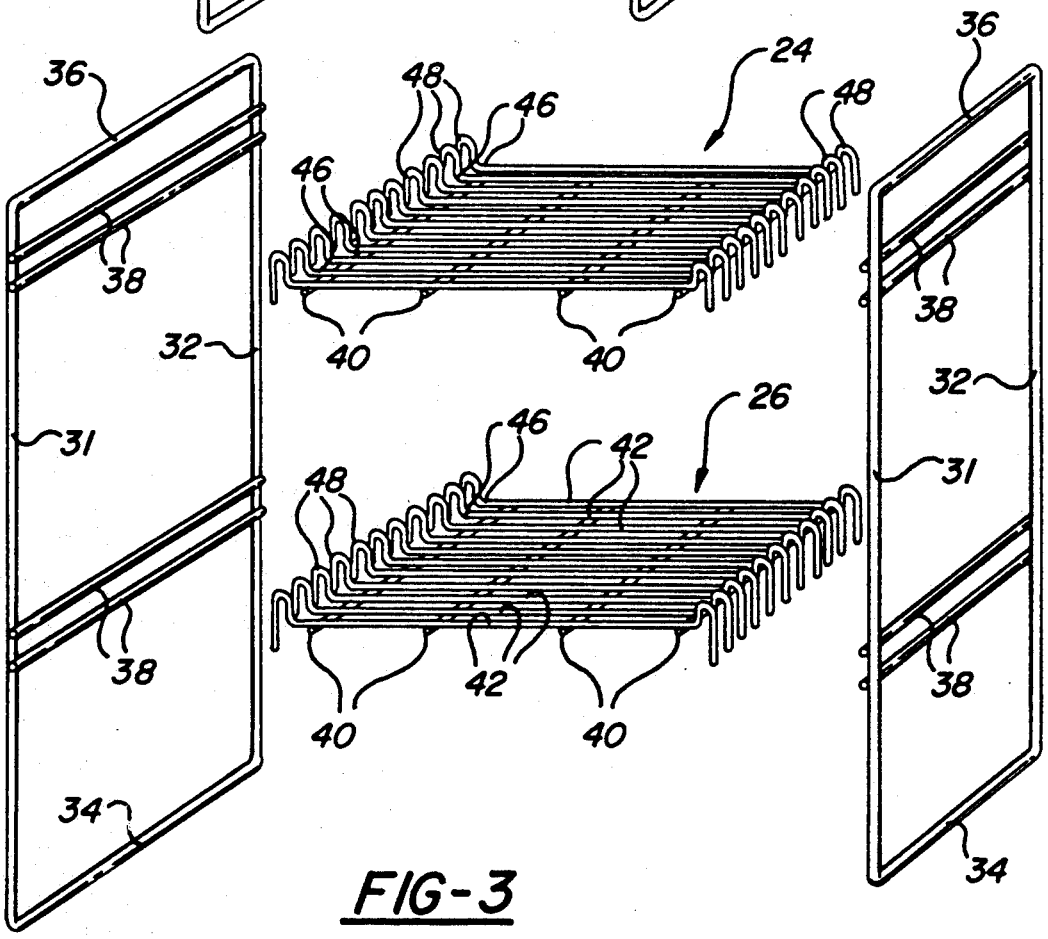
FIG. 3 is a perspective view of the components forming the shelving assembly of FIG. 1 in exploded form.

The ends of the lateral cross members 42 extend at each end beyond their intersection with the outermost front-to-rear members 40 to form planar projecting sections 46 which terminate in U-shaped hooks 48. As illustrated in FIG. 4, each hook 48 has an inner leg 50 and an outer leg 52. The legs extend parallel to one another and are preferably spaced by about ¼ inch. The legs preferably have a height of about ¾ of an inch. As illustrated in FIG. 4, the U-shaped hooks are adapted to extend over and embrace a pair of the horizontally extending rods 38 which form the shelf supporting structure of the side members 28 and 30.

The shelves 24 and 26 are easily assembled to the side members by slipping the U-shaped hooks 48 over opposed pairs the rods 30. The shelf 24 is thus supported on the vertically upper series of rods 38 of the pair of opposed side members and the shelf 26 is supported on the lower pair of rods 38. In an alternative embodiment of the invention additional pairs of rods 38 could be provided and additional shelves could be supported on them.

Because of the spacing between each pair of rods 38, they form the equivalent of a vertically extending structure which gives lateral stability to the assembled shelf section. In alternative embodiments the pair of rods 38 could be replaced by flat plate which would similarly engage the U-shaped hooks to provide stability to the structure.

Additional stability to the structure arises from the fact that the length of the rods 42 between the U-shaped hook sections 48 disposed at both their ends is such as to force the side members 28 and 30 into abutment with the opposed side walls 14 of the locker.

The construction of the shelf members 24 and 26 out of rods prevents the accumulation of dust and debris on the shelves, aiding the housekeeping function of the shelving assembly.

When the sections forming the shelf assembly are disassembled, they are all substantially planar, with the exception of the lateral extension of the hooks 48 beyond the planes of the shelves and they can be readily packaged in a flat container for storage or shipping purposes.

Having thus disclosed my invention I claim:

1. A shelf assembly for use within a storage locker of the type having a pair of opposed side walls, said assembly comprising:

a pair of side members, each adapted to be supported in abutment with one of said side walls of the locker, each side member including a pair of rods adapted to be supported vertically, one at the front and one at the back of a side of the locker, and at least one horizontal shelf supporting structure having each of its ends affixed to one of said pair of rods, said shelf supporting structure comprising a pair of horizontally aligned, vertically spaced rods; and at least one shelf member having a substantially planar support structure and two sets of U-shaped hook members secured to opposite sides of said shelf member and projecting normally to the plane of the shelf member, said U-shaped hook members having depths greater than the vertical spacing between said pair of rods comprising said shelf supporting structure, each hook member being adapted to be arrayed over one of said horizontal shelf supporting structures forming part of one of the side members so that the U-shaped hook members have their open ends facing downwardly and engage both of said pair of rods comprising said shelf supporting structure, with the planar structure of said shelf member to which they are affixed being supported horizontally between said pair of side members with the hook structures extending upwardly from said planar structure so that said hook members and said U-shaped supporting structures providing upstanding side edges to said shelf member;

whereby said shelf member supports the side members against said opposed storage locker side walls, to provide stability to the shelf assembly.

2. The storage shelf assembly of claim 1 including at least two vertically spaced horizontal shelf supporting structures formed on each of the side members.

3. The storage shelf assembly of claim 1 wherein the planar structure of said shelf member comprises a rectangular grid of elongated rods with the rods being secured to one another at their intersections and the two sets of U-shaped hook members formed on each shelf member comprise end sections of the opposed ends of one of the sets of rods.

4. A storage shelf assembly adapted for use with a storage locker having a pair of parallel, planar side walls, said shelf assembly comprising:

a pair of side members, each adapted to be supported in abutment with one of said storage locker side walls, each side member comprising an elongated rod bent into a closed rectangular configuration including a pair of vertical rod sections spaced so as to be disposed adjacent the front end and rear end of the locker side wall and horizontally disposed bottom rod section adapted to be supported on the locker base, and a pair of elongated, horizontally arrayed shelf supporting sections each having their opposed ends affixed to one of said vertical rod sections, each such shelf supporting section comprising a pair of horizontally extending, vertically arrayed, closely spaced rods having their ends fixed to vertical rod sections, the horizontal shelf supporting sections being spaced from one another along the length of the vertical rod sections; and a pair of shelf members each consisting of a rectangular array of wire rods affixed to one another at their intersections, the ends of the rods forming two opposed sides of each array being bent into U-shaped hooks adapted to extend over and engage said horizontal shelf supporting structures so that the open ends of the hooks project downwardly and engage both rods of said horizontal shelf supporting sections whereby said shelves space the side members from one another so that said side members are supported in abutment to the storage locker side walls, providing stability to said shelf assembly.

* * * * *